United States Patent [19]

Beneze

[11] Patent Number: 4,620,402

[45] Date of Patent: Nov. 4, 1986

[54] PENETRATING ROOFING FASTENING AND SEALING SYSTEM

[75] Inventor: Heinz W. Beneze, Richfield, Ohio

[73] Assignee: The Firestone Tire & Rubber Company, Ohio

[21] Appl. No.: 693,639

[22] Filed: Jan. 22, 1985

[51] Int. Cl.[4] ..... E04B 5/00; E04B 1/38; F16B 33/00

[52] U.S. Cl. ..... 52/410; 52/506; 411/369

[58] Field of Search ..... 52/410, 469, 417, 521, 52/466, 467, 408, 222, 506; 24/459, 525; 411/368, 369, 531, 542, 369

[56] References Cited

U.S. PATENT DOCUMENTS

| | | | |
|---|---|---|---|
| 1,084,339 | 1/1914 | Holzberg | 24/459 |
| 4,074,501 | 2/1978 | Sandqvist | 52/741 |
| 4,393,558 | 7/1983 | Herwegh et al. | 24/459 |
| 4,445,306 | 5/1984 | Schauffele | 52/410 |
| 4,455,804 | 6/1984 | Francovitch | 52/698 |
| 4,467,581 | 8/1984 | Francovitch | 52/410 |
| 4,471,548 | 9/1984 | Goudie | 52/646 |
| 4,520,606 | 6/1985 | Francovitch | 52/410 |

FOREIGN PATENT DOCUMENTS

| | | | |
|---|---|---|---|
| 737640 | 7/1966 | Canada | 52/506 |
| 2433669 | 1/1976 | Fed. Rep. of Germany . | |

*Primary Examiner*—Carl D. Friedman
*Assistant Examiner*—John Malcolm White
*Attorney, Agent, or Firm*—Ernst H. Ruf

[57] ABSTRACT

A penetrating roofing fastening and sealing system for securing a flexible sheet, having a plurality of apertures, to the upper surface of a roof via the use of a plurality of spaced penetrating fastening and sealing devices, each of which includes upper and lower retainers, wherein the latter are anchored to the roofing surface and the elastomeric sheet has a continuous peripheral portion, adjacent each aperture, confined between opposing flange portions of the upper and lower retainers, the retainers being clamped together in a sealing relationship with the interposed sheet portion. A method for securing and sealing the flexible sheet to the roofing substrate is also presented.

20 Claims, 4 Drawing Figures

PENETRATING ROOFING FASTENING AND SEALING SYSTEM

TECHNICAL FIELD

The field of art to which this invention pertains is that of mechanical fastening systems, particularly to a fastening and sealing device for mechanically securing a flexible sheet, having an aperture, to a roofing substrate in a continuous sealing relationship with the device.

BACKGROUND OF THE ART

A large number of commercial and factory or plant roofs are of a flat roof design wherein the roofing material itself is often of a built-up asphalt and, in more modern systems, of a single ply EPDM elastomeric sheet or membrane. In terms of securing a single ply EPDM membrane to the roof itself, one design utilizes a mechanical ballast system that uses a layer of stone over the membrane. While the ballast system is least expensive, it has the disadvantage of being quite heavy (approximately 10 pounds per sq. foot) thus requiring a heavy roof support structure and, in addition, the roof slope cannot exceed 10°.

Adhered roof membrane retention systems suffer from a cost penalty while mechanical fastening systems generally require a fixation to the roofing substrate via mechanical fasteners. There are two basic kinds of such mechanical fasteners, namely membrane penetrating and non-penetrating ones. Each of these types of fasteners has a number of favorable features and each of them is also subject to various drawbacks and disadvantages.

An example of a non-penetrating type fastener is shown in German Patent publication No. 2,433,669 to Ott, which discloses a membrane fastener comprising a lower disc attached to a roofing substrate by anchoring member. The roofing membrane is fitted over the lower disc and an upper disc is snapped over the lower disc to perfect the fastening and exert a sealing effect. A plug is then driven into the upper disc to expand the body thereof into an annular space provided in the lower disc to anchor the upper disc to the lower disc. Non-penetrating fastener or anchoring systems have the disadvantage of introducing wrinkles into the elastomeric membrane. Wrinkles are indicative of tension and tension, in rubber, is known to cause undesirable cracks.

Mechanical fastening systems, of the penetrating type, generally require fixation to the roofing substrate by a metal fastener with metal or rubberized nailing strips. U.S. Pat. No. 4,445,306 to Schauffele sets forth a mechanically attached roofing system wherein an elongated fastening bar is placed above the membrane and fastened to the roofing structure with fasteners such as screws or nails which are driven through the bar from the top thereof through the underlying membrane into the roofing structure. An elongated waterproof strip, sandwiched beneath the bottom of the bar and the membrane, and through which the fasteners pass, has its marginal sections wrapped upwardly around the bar to overlap each other above the bar and the head of each fastener.

U.S. Pat. No. 4,074,501 to Sandqvist discloses a method and apparatus for securing a sealing layer on a flat roof by means of a number of plates and screws passing through those plates. A membrane layer is attached to a roofing substrate by means of a plate composed of a semi-rigid material in which is formed a centrally located aperture into which is inserted a self-cutting screw that anchors the assembly to the roofing substrate. A bonding agent is required at the screw and the plate edges.

U.S. Pat. Nos. 4,455,804 and 4,467,581 to Francovitch both pertain to membrane anchors wherein the former utilizes a disc of rubber-like material having a central opening and downwardly inclined upper and lower surfaces, the lower surface having grooves for receiving mastic. A linear fastener extends through a central opening. The latter pertains to a resilient metal anchoring system composed of resilient metal that secures a roofing membrane to a substrate wherein the disc-like anchor, having downwardly facing cavities, is anchored to the substrate by a fastener. Grooves below the central region serve to seal the membrane around a perforation formed by the fastener and flexure zones on the outer periphery of the anchor further serve to seal the membrane.

DISCLOSURE OF THE INVENTION

The present invention provides a solution to the deficiencies of the previously-discussed prior art penetrating fastener constructions by permitting attachment of a flexible waterproof membrane to an underlying roofing structure by mechanical means that consist of two circular discs that are pressed against each other by clamping means wherein the discs utilize the membrane itself as a seal therebetween. No adhesive or any other sealing is required. In addition, clamping force and anchoring force are two separate entities since the means for anchoring the lower disc or retainer to the roofing structure is totally separate from the means for clamping the discs or retainers together.

In the penetrating, fastening and sealing device of the present invention, a flexible elastomeric sheet is mechanically secured to the upper surface of a roof, wherein the elastomeric sheet is first provided with a plurality of apertures and thereafter, at each aperture, a rigid lower retainer, having an area greater than that of the sheet apertures is passed therethrough so as to underlie and completely cover the aperture. The lower retainer has a planar bottom surface and a planar upper surface with a stepped center portion of the latter having an outer peripheral surface adapted for locating the corresponding wall portion of the sheet that defines the aperture. A continuous outer flange portion is adapted to underlie a corresponding portion of the lower surface of the sheet.

The lower retainer is adapted to be passed through the sheet aperture via temporary elastic deformation of the sheet adjacent to the aperture so that the planar bottom surface overlies the upper surface of the roof and the stepped center portion is aligned with and locates the sheet aperture. Anchoring means are utilized for anchoring the lower retainer to the roof upper surface.

A rigid upper retainer, having an area greater than that of the sheet aperture is adapted to overlie and completely cover the aperture. The upper retainer has an upper surface and a planar lower surface, with a stepped center portion of the latter having an area and size approximately corresponding with those of the lower retainer center portion. This center portion also has an outer peripheral surface adapted to matingly engage with the outer peripheral surface of the lower retainer center portion. A continuous outer flange portion is adapted to overlie a corresponding portion of the upper surface of the sheet.

The two flange portions cooperate to confine a continuous portion of the sheet, bordering the aperture, therebetween, with the clamping means pressing together the upper and lower retainers into a continuous sealing relationship with the sheet or membrane.

The method for mechanically securing and sealing the flexible elastomeric sheet to the upper surface of a roof, via the use of a plurality of spaced penetrating, fastening and sealing devices, includes the steps of spreading the flexible elastomeric sheet over the roof upper surface; determining the desired locations for the devices on the sheet; providing the sheet, at these locations, with apertures; passing, at each location, the lower retainer, which is larger than the aperture, through the aperture and centering the retainer relative to the aperture; anchoring the lower retainer to the roof upper surface; placing, at each location, the upper retainer over the lower retainer in an aligned manner so that opposed flange portions thereof confine a continuous peripheral portion of the sheet, adjacent, the sheet aperture, therebetween; and pressing the upper and lower retainers together so as to achieve a continuous sealing relationship with the sheet.

Other features and the advantages of the present invention will become more readily understood by persons skilled in the art when following the best mode description in conjunction with the several drawings.

BEST MODE FOR CARRYING OUT THE INVENTION

Figure 1:
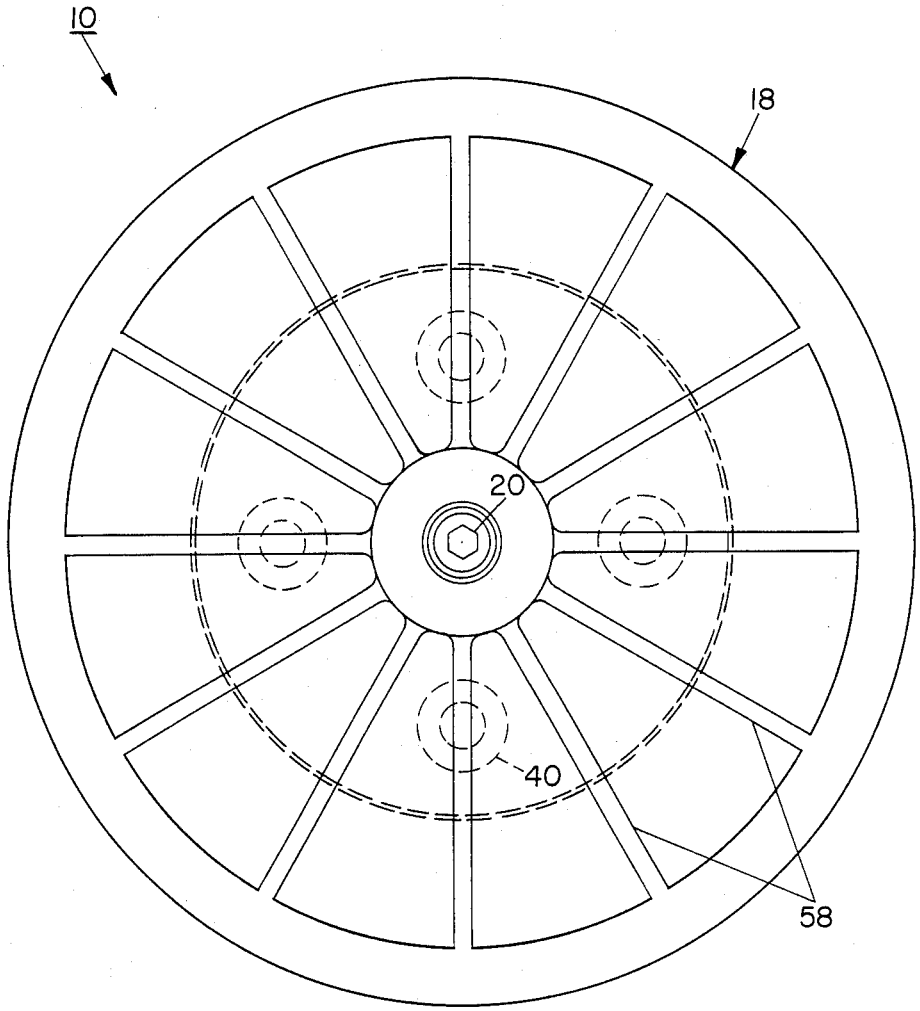
FIG. 1 is a top plan view of the penetrating roofing fastener of the present invention.
Figure 2:
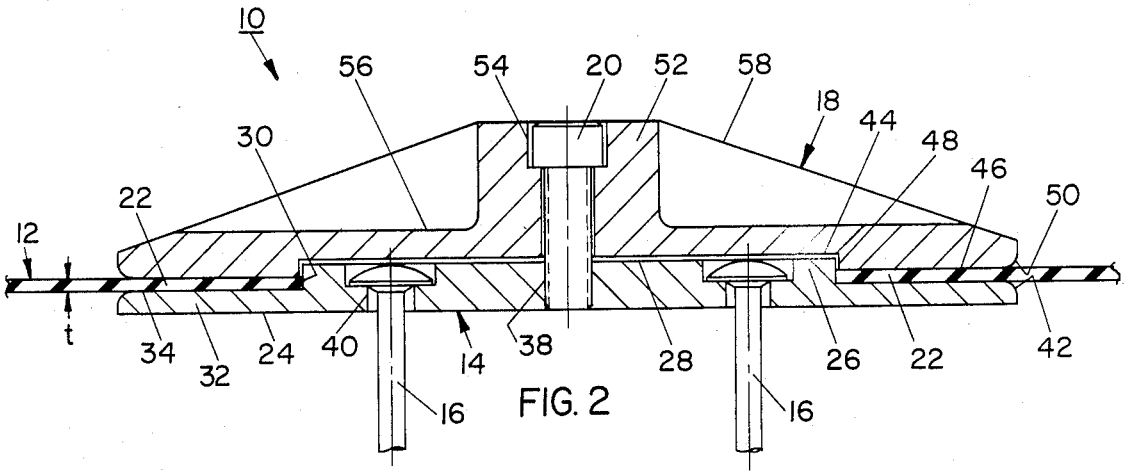
FIG. 2 is a cross-sectional view of the penetrating roofing fastener of FIG. 1 together with the interposed roofing membrane, anchoring means and fastening means.

Referring now to the drawings, specifically FIGS. 1 and 2, there is illustrated the penetrating roofing fastener 10 of the present invention. Fastener 10, basically includes rigid lower retainer 14, anchoring means 16, rigid upper retainer 18 and clamping means 20. Lower and upper retainers 14 and 20 are utilized for securing an annular portion 22 of a flexible sheet or membrane 12 therebetween in a manner to be described hereinafter.

Rigid lower retainer 14, which is preferably circular, includes a planar flat bottom surface 24, a circular stepped central portion 26 having a circular flat top surface 28 and an annular peripheral surface 30. Lower retainer 14 further includes a peripheral outer flange portion 32 having an annular top surface 34 with vertical annular peripheral surface 30 serving to connect parallel but vertically spaced surfaces 28 and 34.

Circular stepped central portion 26 of lower retainer 14 is also provided with a threaded central aperture 38 and a plurality of preferably equally radially end circumferentially spaced stepped apertures 40. Apertures 40 in turn permit the partial passage therethrough of anchoring means 16 which preferably take the form of a self threading spike, screw or anchor bolt which is utilized to anchor lower retainer 14 to a roofing substrate (not shown) in any desired manner. Stepped apertures 40 have a recess of sufficient depth to permit the complete countersinking of the head of anchoring means 16.

Turning now to rigid upper retainer 18, it includes a circular stepped or recessed central lower surface portion 44, whose diameter is slightly greater than that of lower retainer stepped central portion 26. Upper retainer 18 further includes a peripheral lower surface flange portion 46 of a size preferably approximating that of lower retainer peripheral flange portion 32. Surfaces 44 and 46, while being parallel, are joined by stepped portion vertical annular peripheral surface 48.

Upper retainer 18 also includes a central preferably circular, boss portion 52 having a stepped central aperture 54 which is concentric with lower retainer threaded central aperture 38. The top surface 56 of upper retainer 18, which merges into boss portion 52 may also be provided with a plurality of equally spaced and radially directed stiffening ribs 58 if so desired. Preferably, the radially outermost edge 50 of lower surface flange portion 46 is bevelled or radiused to remove any sharp corners. Similarly, outer edge 42 of lower retainer peripheral flange portion 32 is also smoothly radiused for the same reason.

As best seen in FIG. 2, upper retainer 18 is adapted to be juxtaposed or contiguous with lower retainer 14, with the latter being centered or located relative to the former via the engagement of lower retainer stepped central portion 26 with upper retainer stepped or recessed central portion 44. The vertical extent of annular peripheral surface 30 is greater than the vertical extent of essentially corresponding surface 48 thus permitting the insertion, between opposing annular surfaces 34 and 46, of a corresponding annular or ring shaped portion 22 of flexible membrane 12 of a predetermined thickness t.

Again, as best seen in FIG. 2, clamping means 20, which preferably takes the form of a socket head cap screw, is inserted into upper retainer stepped central aperture 54 and cooperates with lower retainer threaded aperture 38 to press upper retainer 18 against lower retainer 14 to thereby sealingly retain membrane annular portion 22 therebetween. If so desired, stepped aperture 54 and/or clamping means or cap screw 20 could be provided with a sealing member (not shown), such as an O ring, cap or resilient disc, etc.

Figure 3:
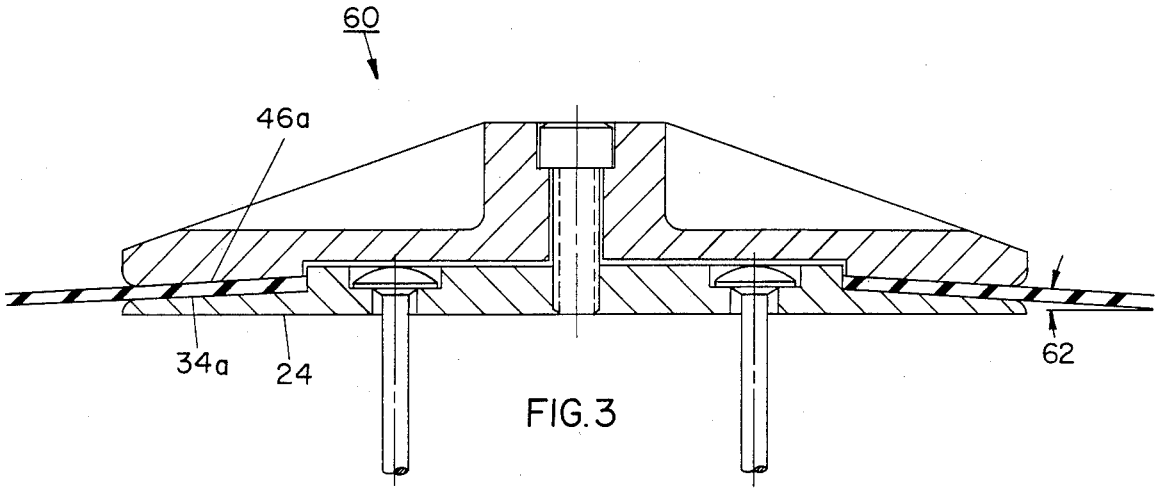
FIG. 3 is a view similar to that of FIG. 2 but showing a modification thereof.

As shown in FIGS. 1 and 2 opposing flange surfaces 34 and 46 are parallel with surface 34 also being parallel with bottom surface 24. Penetrating roofing fastener 60, shown in FIG. 3, is very similar to fastener 10, with like numbers being applicable to like parts, the major difference being that while opposing flange surfaces **34*a* and 46*a* are still parallel to each other, they are slightly upwardly and inwardly angled, as shown by numeral 62, relative to lower retainer bottom wall 24, such angulation contributing to the sealing affect relative to membrane portion 12** since water always seeks the lowest level.

Figure 4:
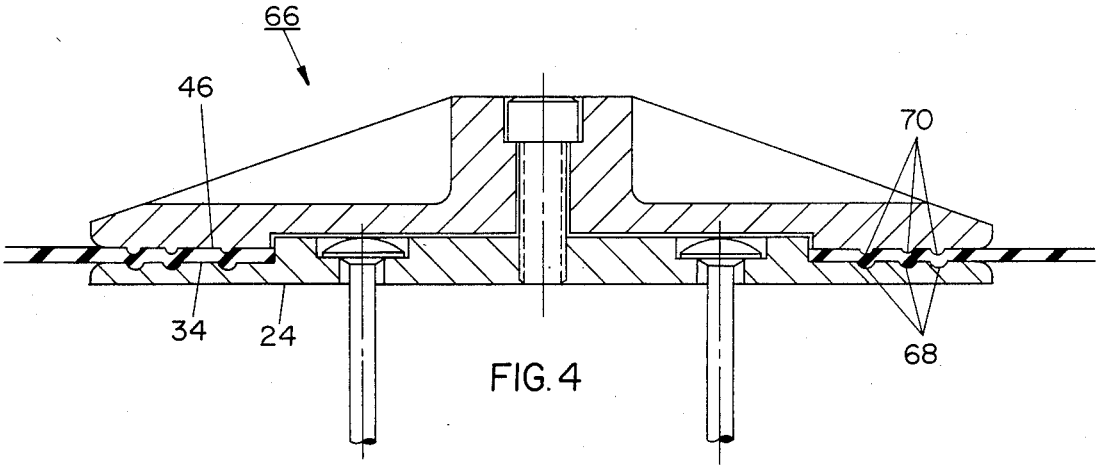
FIG. 4 is a view similar to that of FIG. 2 but showing another modification thereof.

Penetrating roofing fastener 66 shown in FIG. 4 is again very similar to fastener 10, with like numerals again being applicable to like parts. Flange surfaces 34 and 46 are again parallel with each other and parallel with lower retainer bottom surface 24 but in the interest of optimising water tightness, flange surface 34 is provided with a plurality of radially spaced circularly extending concentric annular grooves 68 while flange surface 46 is provided with a similar plurality of corresponding raised land areas 70 with grooves 68 and land areas 70 cooperating to successively clamp membrane portion 22 therebetween.

In terms of the method or process for utilizing penetrating fastener 10 (or 60 and 66), flexible elastomeric sheet or membrane 12 is first spread over the roofing substrate (not shown) so as to totally cover same. Thereafter, the number of fasteners 10 and their location is determined while avoiding interferences such as lap splices, seams, field splices, protuberances and the like. After the noted positions have been determined, they are appropriately marked and apertures of a diameter substantially similar to that of lower retainer stepped portion 26 are cut through membrane 12 in any well known or desired manner, such as, for example, by using a die punch. Thereafter, at each location, a rigid lower retainer 14 is passed through the sheet aperture via the temporary elastic deformation of the sheet adjacent to the aperture so that the peripheral vertical edge of the aperture coincides with and is located on vertical annular surface 30 of lower retainer central portion 26. It should be understood at this time that annular membrane portion 22, which corresponds in size and shape to lower retainer peripheral flange portion 32, now of course is juxtaposed or overlies flange annular top surface 34. At this time, lower retainer 14 is physically anchored to the upper surface (not shown) of the roofing substrate preferably via at least two spikes 16. Although one spike is usually all that is necessary to achieve this anchoring, multiple apertures 40 are provided in case the roofing substrate contains a void area so that more than one fastening attempt can be made.

The physical anchoring of lower retainer 14 is followed by the placement of upper retainer 18 over the lower retainer so that upper retainer stepped recessed portion 44 is located or matingly engages with the corresponding stepped portion 26 of lower retainer 14. This is folowed by the insertion of socket head cap screw 20 into stepped aperture 54 and the engagement of the former with lower retainer threaded central aperture 38. The tightening of cap screw 20 of course not only fixedly retains membrane annular portion 22 between opposing flange portions 32 and 46, but membrane portion 22 also acts as a gasket, thus producing a continuous water tight seal between retainers 14 and 18.

Retainers 14 and 18 are preferably made of a rigid light weight material, such as for example, aluminum or a high strength plastic. The membrane thickness t is not a limiting factor as long as the axial or vertical extent of annular peripheral surface 30 of lower retainer 14 exceeds the membrane thickness in order to permit mating engagement with upper retainer 18.

The actual dimensions of retainers 14 and 18 can of course vary depending on the wind lift requirements in the areas of installation. Fasteners have been successfully tested wherein the diameters of the retainers are about 5 inches, the central stepped portions were approximately 3 inches in diameter and the transverse width of the annular flange portions were about 1 inch. Similarly, the shape or configuration of the upper surface of upper retainer 18 can vary and the number of stiffening ribs 58 may also vary, depending on the inherent material stiffness. As previously noted, it is preferred that edges 42 and 50 be radiused or relieved in order to remove any possibility of a sharp edge that could cut or gouge membrane 12.

Penetrating roofing fastener 10 has a number of advantages over prior art devices that use a single central retainer, such as a bolt or nail to both attach the fastener to the roof and clamp the membrane between opposed fastener portions. In the present invention, the clamping pressure between the upper and lower retainer can be exerted independent of the pressure required to anchor the bottom retainer to the roof structure. In addition, where needed, several screws or anchor bolts can be used to anchor the lower retainer to the roofing substrate. Furthermore, fastener 10 can accommodate all known gages of membranes that are currently used for these types of applications. Fastener 10 is suitable for flat roofs as well as spherical roofs and, and very importantly so, membrane 12 itself serves as a gasket, with no additional sealants being required.

The penetrating fastener of the present invention also has the distinct advantages over non-penetrating type fasteners in that it does not introduce tension or wrinkles into the membrane as do all non-penetrating anchoring systems. Furthermore, there is no interference with factory or field splices or laps and seams or the like, since these fasteners are placed after the membrane has already been spread out over the roofing substrate. Furthermore, since the clamping force and the anchoring force are two separate entities, they may differ in magnitude depending on building site requirements.

The penetrating roofing fastening and sealing system of the present invention finds specific utility in mechanically securing elastomeric, such as EPDM, sheeting in flat or spherical roofing applications. However, from the foregoing description, when read in light of the several drawings, it is believed that those familiar with the art will readily recognize and appreciate the novel concepts and features of the present invention. Obviously, while the invention has been described in relation to only a limited number of embodiments, numerous variations, changes, substitutions and equivalents will present themselves to persons skilled in the art and may be made without necessarily departing from the scope and principles of this invention. As a result, the embodiments described herein are subject to various modifications, changes and the like without departing from the spirit and scope of the invention with the latter being determined soley by reference to the claims appended hereto.

What is claimed is:

1. A penetrating, fastening and sealing device for both mechanically securing a flexible elastomeric sheet, of a range of thicknesses, to the upper surface of a roof, and sealingly engaging said sheet, wherein said sheet is provided with an aperture of a first predetermined area and shape, said device comprising a combination:

(a) a rigid lower retainer, having an area greater than said sheet aperture area, adapted to be passed through said sheet aperture so as to underlie and completely cover said aperture, said lower retainer having a bottom surface and an upper surface, with the center portion of the lower retainer being stepped having an area and shape generally corresponding with those of said sheet aperture and having an outer peripheral surface adapted for locating the corresponding peripheral wall portion of the sheet that defines said sheet aperture, said upper surface of the lower retainer further including a continuous outer flange portion adapted to underlie a corresponding portion of a lower surface of said sheet, and said bottom surface of the lower retainer overlying said upper roof surface and said center portion being aligned with and extending into said sheet aperture;

(b) means for anchoring aid lower retainer to said roof upper surface;

(c) a rigid upper retainer, having an area greater than said sheet aperture area, adapted to overlie and completely cover said aperture, thereby confining a continuous peripheral portion of said sheet, bordering said sheet aperture, between said upper and lower retainers; and (d) separate fastener means engageable with a center portion of the upper retainer and extending from said upper retainer into a center portion of the lower retainer for drawing said retainers perpendicularly against each other to sealingly secure the elastomeric sheet between said retainers.

2. The penetrating, fastening and sealing device of claim 1 wherein said upper retainer is of a third predetermined area and shape, said upper retainer having an upper surface and a planar lower surface, with the center portion of the upper retainer being stepped having an area and size generally corresponding with those of said lower retainer center portion.

3. The penetrating, fastening and sealing device of claim 2 wherein said upper retainer center portion also has an outer peripheral surface adapted to matingly engage with the outer peripheral surface of said lower retainer center portion, said lower surface further including a continuous outer flange portion adapted to overlie a corresponding portion of the upper surface of said sheet.

4. The penetrating, fastening and sealing device of claim 3 wherein said upper retainer lower surface flange portion is of the size and shape so as to overlap, at least a circumferentially continuous portion, of said lower retainer outer flange portion to thereby confine said continuous portion of said sheet, bordering said aperture, between said upper and lower retainer flange portions.

5. The penetrating, fastening and sealing device of claim 1 wherein said lower retainer stepped central portion is provided with at least two circumferentially spaced apertures adapted for receiving said means for anchoring.

6. The penetrating, fastening and sealing device of claim 1 wherein said lower retainer stepped central portion is provided with a threaded central aperture adapted to cooperate with said separate fastener means for drawing the retainers perpendicularly against each other.

7. The penetrating, fastening and sealing device of claim 1 wherein said upper retainer also includes a central boss portion having a stepped central aperture which is adapted to receive separate fastener means for drawing the retainers perpendicularly against each other.

8. The penetrating, fastening and sealing device of claim 1 wherein said upper retainer is provided with a plurality of radially directed stiffening ribs.

9. A penetrating, fastening and sealing device for both mechanically securing a flexible elastomeric sheet, of known thickness, to the upper surface of a roof and sealingly engaging said sheet, wherein said sheet is provided with an aperture of a first predetermined area and shape, said device comprising in combination: a rigid lower retainer; means for anchoring said lower retainer to said roof upper surface; a rigid upper retainer adapted to mate with said lower retainer; and means for clamping said upper and lower retainers together, (a) said lower retainer being of a second predetermined area and shape, said second area being greater than said sheet aperture area, said lower retainer having a planar bottom surface and a planar upper surface, a stepped center portion thereof having an area and shape substantially corresponding with those of said sheet aperture, said center portion also having an outer peripheral surface adapted for locating the corresponding peripheral wall portion of the sheet that defines said aperture, said upper surface further including a continuous outer flange portion adapted to underlie a corresponding portion of the lower surface of said sheet, said lower retainer being adapted to be passed through said sheet aperture, via temporary elastic deformation of said sheet adjacent said aperture, so that said planar bottom surface overlies said roof upper surface and said stepped center portion is aligned with said sheet aperture;

(b) said upper retainer being of a third predetermined area and shape, said third area being greater than said sheet aperture area, said upper retainer having an upper surface and a planar lower surface, a stepped center portion thereof having an area and size substantially corresponding with those of said lower retainer center portion, said upper retainer center portion also having an outer peripheral surface adapted to matingly engage with the outer periheral surface of said lower retainer center portion, said lower surface further including a continuous outer flange portion adapted to overlie a corresponding portion of the upper surface of said sheet, said lower surface flange portion being of a size and shape so as to overlap, at least a circumferentially continuous portion, of said lower retainer outer flange portion and thereby confining a continuous portion of said sheet, bordering said aperture, between said upper and lower retainer flange portions;

(c) said clamping means including separate fastener means engageable with a center portion of the upper retainer and extending from said upper portion into a center portion of the lower retainer for drawing said retainers perpendicularly against each other to sealingly secure the elastomeric sheet between said retainers.

10. The penetrating, fastening and sealing device of claim 9 wherein the flange portions of said upper and lower retainers are parallel with each other and said lower retainer bottom surface.

11. The penetrating, fastening and sealing device of claim 9 wherein the opposing surfaces of said upper and lower retainer flange portions are parallel with each other but angled relative to the lower retainer bottom surface.

12. The penetrating, fastening and sealing device of claim 9 wherein the opposing flange surfaces of said upper and lower retainers are parallel to one another, one of said surfaces being provided with a plurality of radially spaced circularly extending concentric annular grooves while the other of said surfaces is provided with a similar plurality of corresponding raised land areas, said grooves and land areas cooperating to successively clamp said sheet therebetween.

13. A method for mechanically securing and sealing a flexible elastomeric sheet to the upper surface of a roof via the use of a plurality of spaced penetrating fastening and sealing devices, each of which includes upper and lower retainers, means for anchoring said lower retainer to said roof upper surface and means for clamping said upper and lower retainers together, each of said devices being used in conjunction with an aperture through said sheet, said method comprising the steps of:

a. spreading said flexible elastomeric sheet over said roof upper surface.

b. determining desired locations for said devices on said sheet;

c. providing, at said location, said sheet with an aperture;

d. passing, at each location, said lower retainer, which is larger than said aperture, through said sheet aperture to underlie and completely cover said aperture;

e. physically anchoring said lower retainer to said roof upper surface at each of said locations;

f. placing, at each location, said upper retainer, which is larger than said aperture, over said aperture to overlie and completely cover said aperture, thereby confining a continuous peripheral portion of said sheet, bordering said aperture, between said upper and lower retainers; and g. pressing said upper and lower retainers together which results in a continuous sealing relationship with said sheet.

14. The method of claim 13, wherein said passing step is accomplished via the temporary elastic deformation of said sheet adjacent said aperture.

15. The method of claim 13 wherein said passing step includes coinciding said aperture with a stepped center portion of said lower retainer upper surface and placing the bottom surface of said lower retainer on said roof upper surface.

16. The method of claim 15 wherein the upper surface of said lower retainer includes a continuous outer flange portion that underlies a corresponding portion of the lower surface of said sheet.

17. The method of claim 16 wherein said placing step includes matingly engaging said lower retainer stepped center portion with a corresponding center portion of said upper retainer lower surface, with a continuous outer flange portion of said lower surface being adapted to overlie at least a continuous portion of said lower retainer outer flange portion, thereby confining a continuous peripheral portion of said sheet therebetween.

18. A method for mechanically securing and sealing a flexible elastomeric sheet to the upper surface of a roof via the use of a plurality of spaced penetrating fastening and sealing devices, each of which includes upper and lower retainers, means for anchoring said lower retainer to said roof upper surface and means for clamping said upper and lower retainers together, each of said devices being used in conjunction with an aperture through said sheet, said method comprising the steps of:

a. spreading said flexible elastomeric sheet over said roof upper surface;

b. determining desired locations for said devices on said sheet;

c. providing, at said locations, said sheet with an aperture of a first predetermined size;

d. passing, at each location, asid lower retainer, which is of a second predetermined size larger than said first predetermined size, through said sheet aperture, via temporary elastic deformation of said sheet adjacent said aperture, so that the edge of said aperture substantially coincides with a stepped center portion of said lower retainer upper surface and the bottom surface of said lower retainer overlies said roof upper surface, with a continuous outer flange portion of said upper surface underlying a corresponding portion of the lower surface of said sheet;

e. physically anchoring said lower retainer to said roof upper surface at each of said locations;

f. placing, at each location, said upper retainer, which is of a third predetermined size larger than said first predetermined size, over said lower retainer stepped portion so that it matingly engages with a correspondding center portion of said upper retainer lower surface, with a continuous outer fange portion of said lower surface being adapted to overlie a corresponding portion of the upper surface of said sheet, said lower surface flange portion being of the size and shape so as to overlay at least a continuous portion of said lower retainer outer flange portion, thereby confining a continuous peripheral portion of said sheet, bordering said aperture, between said upper and lower retainers; and g. pressing said upper and lower retainers together which results in a continuous sealing relationship with said sheet.

19. A penetrating, fastening and sealing device for both mechanically securing a flexible elastomeric sheet, of known thickness, to the upper surface of a roof and sealingly engaging said sheet, wherein said sheet is provided with an aperture of a first predetermined area and shape, said device comprising in combination: a rigid lower retainer; means for anchoring said lower retainer to said roof upper surface; a rigid upper retainer adapted to mate with said lower retainer; and means for clamping said upper and lower retainers together, (a) said lower retainer being of a second predetermined area and shape, said second area being greater than said sheet aperture area, said lower retainer having a planar bottom surface and a planar upper surface, a stepped center portion thereof having an area and shape substantially correspondng with those of said sheet aperture, said center portion also having an outer peripheral surface adapted for locating the corresponding peripheral wall portion of the sheet that defines said aperture, said upper surface further including a continuous outer flange portion adapted to underlie a corresponding portion of the lower surface of said sheet, said lower retainer being adapted to be passed through said sheet aperture, via temporary elastic deformation of said sheet adjacent said aperture, so that said planar bottom surface overlies said roof upper surface and said stepped center portion is aligned with said aperture;

(b) said upper retainer being of a third predetermined area and shape, said third area being greater than said sheet aperture area, said upper retainer having an upper surface and a planar lower surface, a stepped center portion thereof having an area and size substantially corresponding with those of said lower retainer center portion, said upper retainer center portion also having an outer peripheral surface adapted to matingly engage with the outer peripheral surface of said lower retainer center portion, said lower surface further including a continuous outer flange portion adapted to overlie a corresponding portion of the upper surface of said sheet, said lower surface flange portion being of a size and shape so as to overlap, at least a circumferentially continuous portion, of said lower retainer outer flange portion of said sheet, bordering said aperture, between said upper and lower retainer flange portions;

(c) said clamping means pressing together said upper and lower retainers into a continuous sealing relationship with said sheet; and (d) the opposing surfaces of said upper and lower retainer flange portions being parallel with each other but angled relative to the lower retainer bottom surface.

20. A penetrating, fastening and sealing device for both mechanically securing a flexible elastomeric sheet, of known thickness, to the upper surface of a roof and sealingly engaging said sheet, wherein said sheet is provided with an aperture of a first predetermined area and shape, said device comprising in combination: a rigid lower retainer; means for anchoring said lower retainer to said roof upper surface; a rigid upper retainer adapted to mate with said lower retainer; and means for clamping said upper and lower retainers together, (a) said lower retainer being of a second predetermined area and shape, said second area being greater than said sheet aperture area, said lower retainer having a planar bottom surface and a planar upper surface, a stepped center portion thereof having an area and shape substantially corresponding with those of said sheet aperture, said center portion also having an outer peripheral surface adapted for locating the corresponding peripheral wall portion of the sheet that defines said aperture, said upper surface further including a continuous outer flange portion adapted to underlie a corresponding portion of the lower surface of said sheet, said lower retainer being adapted to be passed through said sheet aperture, via temporary elastic deformation of said sheet adjacent said aperture, so that said planar bottom surface overlies said roof upper surface and said stepped center portion is aligned with said aperture;

(b) said upper retainer being of a third predetermined area and shape, said third area being greater than said sheet aperture area, said upper retainer having an upper surface and a planar lower surface, a stepped center portion thereof having an area and size substantially corresponding with those of said lower retainer center portion, said upper retainer center portion also having an outer peripheral surface adapted to matingly engage with the outer peripheral surface of said lower retainer center portion, said lower surface further including a continuous outer flange portion adapted to overlie a corresponding portion of the upper surface of said sheet, said lower surface flange portion being of a size and shape so as to overlap, at least a circumferentially continuous portion, of said lower retainer outer flange portion of said sheet, bordering said aperture, between said upper and lower retainer flange portions;

(c) said clamping means pressing together said upper and lower retainers into a continuous sealing relationship with said sheet; and (d) the opposing flange surfaces of said upper and lower retainers being parallel to one another with one of said surfaces being provided with a plurality of radially spaced circularly extending concentric annular grooves while the other of said surfaces is provided with a similar plurality of corresponding raised land areas, with said grooves and land areas cooperating to successively clamp said sheet therebetween.

* * * * *